United States Patent [19]

Kawakami et al.

[11] 4,137,072

[45] Jan. 30, 1979

[54] ADDITIVE FOR USE IN REFINING IRON

[75] Inventors: Noboru Kawakami, Tokyo; Takeshi Goto, Atsugi; Itsuo Hirano, Sagamihara; Yoichi Itakura, Musashino, all of Japan

[73] Assignee: Toyo Soda Manufacturing Co., Ltd., Japan

[21] Appl. No.: 854,602

[22] Filed: Nov. 25, 1977

[30] Foreign Application Priority Data

Dec. 1, 1976 [JP] Japan ..... 51-143487
Dec. 1, 1976 [JP] Japan ..... 51-143488

[51] Int. Cl.[2] ..... C21C 7/00
[52] U.S. Cl. ..... 75/58; 75/53
[58] Field of Search ..... 75/58, 53

[56] References Cited

U.S. PATENT DOCUMENTS

| | | | |
|---|---|---|---|
| 3,467,167 | 9/1969 | Mahin | 75/58 |
| 3,801,303 | 4/1974 | Kotler | 75/58 |
| 4,035,892 | 7/1977 | Ototani | 75/58 |

*Primary Examiner*—P. D. Rosenberg
*Attorney, Agent, or Firm*—Merchant, Gould, Smith, Edell, Welter & Schmidt

[57] ABSTRACT

Disclosed is an additive in a molded form for use in refining iron. The additive comprises a mixture of at least one metal selected from magnesium, calcium and aluminum, and at least one metal oxide selected from magnesium oxide, calcium oxide and aluminum oxide.

4 Claims, No Drawings

ADDITIVE FOR USE IN REFINING IRON

This invention relates to additives for use in refining iron, particularly additives to be incorporated as a desulfurizer in a molten pig iron or to be incorporated in a molten iron for the purpose of producing ductile cast-iron, i.e., spheroidal graphite cast-iron.

Additives for use in refining iron are usually incorporated in a molten iron. Therefore, a metal additive possessing a relatively high vapor pressure such as metallic magnesium is not advantageous. This is because metallic magnesium causes a radical reaction and, hence, the operation is dangerous and the desulfurization efficiency is undesirably low. In order to obviate such defects, some additives have heretofore been proposed and put to practical use, for example, Fe—Si—Mg, Ni—Mg and Si—Mg alloys, and calcium carbide. These additives are, however, still not satisfactory, particularly in their desulfurizing efficiency.

A main object of the present invention is to provide an additive for use in refining iron, which additive does not have the above-mentioned defects and exhibits an improved desulfurizing efficiency.

Other objects and advantages of the present invention will be apparent from the following description.

In accordance with the present invention there is provided an additive in a molded form for use in refining iron, comprising a mixture of at least one metal selected from the group consisting of magnesium, calcium and aluminum, and at least one metal oxide selected from the group consisting of magnesium oxide, calcium oxide and aluminum oxide.

The additive of the present invention is comprised of a mixture of one or more metals in a metallic form and one or more metal oxides. Magnesium is most preferable among the above-mentioned three metals, and magnesium oxide is most preferable among the above-mentioned three metal oxides. Optimum is a combination of metallic magnesium and magnesium oxide.

The proportion of the metal or metals to the metal oxide or oxides is not particuarly critical and may be suitably determined depending upon factors such as the amount of sulfur contained in the molten iron. Generally the mixture comprises 5 to 90% by weight, more preferably 5 to 80% by weight, of the metal or metals and 10 to 95% by weight, more preferably 20 to 95% by weight, of the metal oxide or oxides, based on the weight of the mixture.

It now has been found that a Mg-MgO mixture which is obtained in the course of producing metallic magnesium from magnesium oxide by using a carbon reduction process, is an optimum additive. In the preparation of such a Mg-MgO mixture, magnesium oxide is reduced by solid carbon at a temperature of higher than approximately 1,500° C., and then, the reduced product is cooled as rapidly as possible to a temperature at which the following reversible reaction does not take place, i.e., below about 400° C.

$$MgO + C \rightleftarrows Mg + CO$$

It is preferable that the cooling of the reduced product be effected by blowing thereagainst a cooling gas such as nitrogen, argon, helium, hydrogen or natural gas. The product obtained by such a cooling procedure is in the form of ultrafine Mg particles having a diameter of equal to or smaller than approximately one micron, which particles are at least partially coated with MgO.

The additive of a molded form may be prepared by molding the metal and metal oxide mixture in a finely divided form into a suitable shape and size, and then, heat-treating the shaped product. Alternatively, the additive may be prepared by molding the finely divided mixture into suitable shape and size by using an organic polymer binding material.

The manner wherein the finely divided mixture is molded is not critical, and the finely divided mixture may be molded by using a conventional molding apparatus and in an inert gas atmosphere, such as nitrogen and argon. The molded product may be of a shape such as granules, pellets, spheres and the like.

The heat treatment of the molded product is carried out at a temperature higher than the melting point of the metal ingredient, but preferably up to 1,100° C. For example, when a Mg-MgO mixture is heat treated at a temperature near the melting point of magnesium, i.e. approximately 650° C., the resulting aggregate is of a structure having magnesium granules uniformly dispersed therein. When the Mg-MgO mixture is heat treated at a temperature of 800° C. to 900° C., the resulting aggregate is of a structure having magnesium layers. In both cases, magnesium functions as binder and results in a rigid product. However, when the heat treatment is carried out at an excessively high temperature, i.e., above 1,100° C., magnesium is vaporized and lost. It is preferable that the heat treatment be carried out in an inert gas atmosphere such as nitrogen or argon and for a period of five minutes to five hours.

The heat-treated molded product is rigid and convenient to handle, because the metal ingredient functions as binder. Furthermore, the molded product exhibits enhanced desulfurization efficiency, because the metal oxide ingredient desirably controls the rate of reaction. Furthermore, a substantial part of metallic magnesium contained in the molded product is not in contact with air, and hence, the molded product exhibits extended shelf life.

The organic polymer binding material, which may be used when the metal-metal oxide mixture is molded, includes, for example, acrylate polymer resins, styrene polymer, resins, polyolefins, epoxy resins, polyvinyl alcohol and carboxymethyl cellulose. The organic polymer binding material may be either solid or liquid. When the polymer binding material is liquid, it may be used as it is. It is preferable, however, that the polymer binding material be used in a solution form dissolved in an conventional organic solvent such as benzene, toluene, xylene, ethyl acetate and methyl ethyl ketone. The solution of the organic polymer binding material may conveniently be used at a concentration of 3% to 25% by weight, preferably 5% to 10% by weight.

The metal-metal oxide mixture is blended with the organic polymer binding material solution, and the blend is molded into a desired shape and size, such as granules, pellets, spheres and the like, by using a conventional molding apparatus. The amount of the binding material solution is preferably at least 5% by weight, based on the weight of the metal-metal oxide mixture. The molded product is then dried in a conventional manner. The size of the molded product is not critical but may conveniently be at least 0.5 mm in diameter or length. The dried molded product is rigid. The finely divided metal particles contained in the molded product are covered with the organic polymer binding material and are not in contact with the air, and therefore, the molded product exhibits extended shelf life. The additive of the present invention may contain other ingredients, such as carbon, besides the metal and the metal oxide, unless the ingredients have a harmful influence upon the iron to be refined.

The additive of the present invention may be incorporated in a molten iron as it is. If desired, the additive may be incorporated after it is crushed into a suitable smaller size.

When the additive of the present invention is incorporated in a molten iron, the metal oxide ingredient in the additive functions as a diluent for the active metal ingredient, and thus, prevents or minimizes the undesirable vaporization of the metal ingredient and moderates the rapid reaction. Therefore, the operation of refining iron involves no risk. Furthermore, the additive of the present invention exhibits improved effects for desulfurizing iron. When the additive is used in the manufacture of ductile cast-iron, the resulting ductile cast-iron has a structure such that fine spheroidal graphite particles are uniformly dispersed in the iron. This is in contrast to a conventional metallic magnesium additive which results in ductile cast-iron having spheroidal graphite particles of a relatively large size which are less uniformly dispersed therein.

The invention is further illustrated with reference to the following examples in which % is by weight unless otherwise specified.

In the examples desulfurization percentage (D.P.) and desulfurization efficiency (D.E.), which are defined by the following equations, were determined.

$$\text{Desulfurization percentage} = [(A-B)/A] \times 100$$

where A is a content of sulfur in a pig iron as measured before desulfirization and B is a content of sulfur in the pig iron as measured after desulfurization.

$$\text{Desulfurization efficiency} = (C/D) \times 100$$

where C is the amount of the single metal ingredient in the additive, which ingredient has been reacted with sulfur contained in a pig iron and D is the amount of the single metal ingredient in the additive incorporated in the pig iron.

EXAMPLE 1

Magnesium oxide was reduced by carbon at 1,850° C. and the gaseous reduction product was quenched by contacting it with gaseous nitrogen, thereby to obtain a metallic magnesium dust. This dust was comprised of 20.3% of magnesium oxide, 70% of metallic magnesium, 5.2% of carbon and 0.5% of nitrogen. Three hundred grams of the dust were mixed with 150 g of a 5% solution in toluene of a 1:1 (by weight) mixture of polymethyl methacrylate and polyethyl acrylate. The mixture was molded into spheres having a diameter of 0.7 mm. The spheres were dried at 80° C. in air. The dried spheres were very rigid.

Using the magnesium-magnesium oxide spheres, desulfurization tests were carried out on a pig iron for ductile cast iron as follows. The apparatus used for the desulfurization tests was of a plunger type made of carbon. The above-mentioned spheres in the amount shown in Table I below were incorporated in 2 kg of the pig iron maintained at a temperature of 1,350° to 1,400° C. in a nitrogen atmosphere.

For a comparison purpose, desulfurization tests were carried out in a similar manner wherein a conventional calcium carbide desulfurizer in the form of finely divided particles, and having a purity of 80%, was used instead of the magnesium-magnesium oxide spheres.

Test results are shown in Table I below.

Table I

| Desulfurizer | Amount of desulfurizer incorporated *1 (g per kg of pig iron) | Content of sulfur in pig iron (%) Before desulfurization | After desulfurization | D.P. (%) | D.E. (%) |
|---|---|---|---|---|---|
| Mg - MgO | 0.31 | 0.026 | 0.007 | 73 | 46 |
| $CaC_2$ | 0.70*2 | 0.026 | 0.019 | 27 | 20 |

*1 The amount of the single magnesium in the additive. This caption has the same meaning in the following tables.
*2 The amount of $CaC_2$ expressed in terms of the amount of pure $CaC_2$.

EXAMPLE 2

Magnesium oxide was reduced by carbon at 1,850° C. and the gaseous reduction product was quenched by contacting it with gaseous nitrogen, thereby to obtain a metallic magnesium dust. This dust contained 28.7% of magnesium oxide, 60% of metallic magnesium, 7.3% of carbon and 1.0% of nitrogen. Five hundred grams of the dust were mixed with 150 g of a polystyrene solution of 5% concentration in toluene in a nitrogen atmosphere. The mixture was press-molded into tablets having a diameter of 30 mm and a thickness of 10 mm at a pressure of 500 kg/cm$^2$. The tablets were very rigid.

Following a procedure similar to that set forth in Example 1, desulfurization tests were carried out by using the above-mentioned tablets. Test results are shown in Table II below.

Table II

| Amount of desulfurizer incorporated (g per kg of pig iron) | Content of sulfur in pig iron (%) Before desulfurization | After desulfurization | D.P. (%) | D.E. (%) |
|---|---|---|---|---|
| 0.29 | 0.029 | 0.011 | 62 | 47 |

EXAMPLE 3

Three hundred grams of a finely divided particle mixture comprised of 20% of magnesium oxide and 80% of metallic magnesium were molded into tablets having a diameter of 30 mm and a thickness of 10 mm, at a pressure of 500 kg/cm$^2$, by using a press-molding machine sealed with nitrogen. The tablets were maintained at 700° C. in an argon atmosphere. The heat-treated tablets were very rigid.

Following a procedure similar to that set forth in Example 1, desulfurization tests were carried out by using the above-mentioned tablets. Test results were shown in Table III below.

Table III

| Amount of desulfurizer incorporated (g per kg of pig iron) | Content of sulfur in pig iron (%) Before desulfurization | After desulfurization | D.P. (%) | D.E. (%) |
|---|---|---|---|---|
| 0.22 | 0.025 | 0.012 | 52 | 45 |

EXAMPLE 4

A metallic magnesium dust was prepared by a procedure similar to that set forth in Example 2, which dust contained 35.0% of magnesium oxide, 50.5% of metallic magnesium, 10.5% of carbon and 1.0% of nitrogen. The metallic magnesium dust was press-molded into tablets in a manner similar to that set forth in Example 3.

Desulfurization tests were carried out by using the above-mentioned tablets and following the procedure set forth in Example 1. Test results are shown in Table IV below.

Table IV

| Amount of desulfurizer incorporated (g per kg of pig iron) | Content of sulfur in pig iron (%) | | D.P. (%) | D.E. (%) |
|---|---|---|---|---|
| | Before desulfurization | After desulfurization | | |
| 0.21 | 0.023 | 0.010 | 57 | 46 |

EXAMPLE 5

Following a procedure similar to that set forth in Example 1, a spherical additive was prepared and the desulfurization test was carried out. In this procedure, a finely divided particle mixture, comprised of 65% of metallic magnesium and 35% of magnesium oxide, was used instead of the metallic magnesium dust. Test results are shown in Table V below.

Table V

| Amount of desulfurizer incorporated (g per kg of pig iron) | Content of sulfur in pig iron (%) | | D.P. (%) | D.E. (%) |
|---|---|---|---|---|
| | Before desulfurization | After desulfurization | | |
| 0.23 | 0.026 | 0.012 | 54 | 45 |

EXAMPLE 6

Magnesium oxide was reduced by carbon at approximately 1,850° C. and the gaseous reduction product was quenched by contacting it with gaseous nitrogen, thereby to obtain a metallic magnesium dust. This dust was composed of particles having a size of 0.1 to 1 micron and contained 30% of metallic magnesium, 16.6% of carbon and 0.4% of nitrogen. The total magnesium content was 58.8%. The dust was mixed with 8%, based on the weight of the dust, of a 5% solution in toluene of polymethyl methacrylate. The mixture was molded into granules having a particle size of 1 mm.

The above-mentioned granules were incorporated in 200 g of a molten pig iron maintained at a pressure of 3 atmosphere by argon in a phosphorizer. The pig iron used contained 3.32% of carbon, 3.22% of silicon, 0.007% of sulfur, 0.006% of phosphorus and 0.01% of manganese. The amount of granules added was 0.5% in terms of the weight of the metallic magnesium contained in the granules and based on the weight of the pig iron. After the molten pig iron was cooled to ambient temperature, testing pieces were cut from the cast-iron. Distribution of spheroidal graphite particles on the cut surfaces of the testing pieces was observed by using a microscope. The spheroidal graphite particles were found to be uniformly dispersed and the number of the graphite particles was 780 per $mm^2$.

For comparison purposes, the above-mentioned procedure was repeated, wherein metallic magnesium granules having a diameter of 1 mm and a purity of 99.9% were used as the additive instead of the magnesium dust granules. The spheroidal graphite particles present in the resulting cast-iron were of a relatively large size and their number per unit area was 440 per $mm^2$.

What we claim is:

1. An additive in a molded form for use in refining iron, comprising a mixture of 5% to 90% by weight of magnesium and 10% to 95% by weight of magnesium oxide.

2. An additive according to claim 1 wherein said mixture is a product obtained by reducing magnesium oxide by solid carbon at a temperature of higher than approximately 1,500° C. and, then quenching the reduction product.

3. An additive according to claim 1 which is prepared by molding the mixture of a finely divided form by using an organic polymer binding material.

4. An additive according to claim 1 which is prepared by molding the mixture of a finely divided form and, then, heating the molded product at a temperature of higher than the melting point of magnesium contained therein but lower than 1,100° C.

* * * * *